US012502621B2

(12) United States Patent
Wadsworth et al.

(10) Patent No.: US 12,502,621 B2
(45) Date of Patent: Dec. 23, 2025

(54) ANIMATED FIGURE WALKING MECHANISM

(71) Applicant: Universal City Studios LLC, Universal City, CA (US)

(72) Inventors: Michael Lee Wadsworth, Orlando, FL (US); Ying Wu, Orlando, FL (US); Timothy J. Eck, Windermere, FL (US); Haz Minor, Wyoming, OH (US)

(73) Assignee: Universal City Studios LLC, Universal City, CA (US)

( * ) Notice: Subject to any disclaimer, the term of this patent is extended or adjusted under 35 U.S.C. 154(b) by 551 days.

(21) Appl. No.: 17/886,252

(22) Filed: Aug. 11, 2022

(65) Prior Publication Data

US 2024/0001255 A1 Jan. 4, 2024

Related U.S. Application Data

(60) Provisional application No. 63/357,434, filed on Jun. 30, 2022.

(51) Int. Cl.
*A63J 19/00* (2006.01)

(52) U.S. Cl.
CPC ..... *A63J 19/00* (2013.01)

(58) Field of Classification Search
CPC ..... A63G 7/00; A63G 31/00; A63G 31/02; A63G 31/3116; A63J 19/00
USPC ..... 472/59, 60
See application file for complete search history.

(56) References Cited

U.S. PATENT DOCUMENTS

| | | | | |
|---|---|---|---|---|
| 5,443,188 | A * | 8/1995 | Kotlarsky | A63H 11/18 223/66 |
| 6,917,175 | B2 | 7/2005 | Hattori et al. | |
| 7,238,079 | B2 | 7/2007 | Madhani et al. | |
| 7,712,640 | B2 * | 5/2010 | Honer | G09B 23/28 223/66 |
| 10,688,401 | B1 * | 6/2020 | Brister | A63G 31/00 |
| 12,027,066 | B2 * | 7/2024 | Purvis | G09B 23/32 |
| 2010/0062868 | A1 * | 3/2010 | Mordelt | A63G 31/02 472/131 |

(Continued)

OTHER PUBLICATIONS

"Marionette," Wikipedia, Wikimedia Foundation, Jun. 5, 2022, 11 pages, https://en.wikipedia.org/wiki/Marionette.

(Continued)

*Primary Examiner* — Eugene L Kim
(74) *Attorney, Agent, or Firm* — Fletcher Yoder, P.C.

(57) ABSTRACT

An ambulatory animated figure system includes an animated figure having a body with a first limb and a second limb extending therefrom. The system also includes a carrier configured to be disposed on a support, and the animated figure extends away from a side of the carrier in a direction. The carrier is coupled to a first limb through a first actuator system, which is configured to move the first limb away from the side of the carrier in the direction and configured to slide an end of the first limb transversely relative to the direction. The carrier is translated relative to the support through a second actuator system. The system also includes a controller communicatively coupled to the first actuator system and the second actuator system and configured to coordinate actuation of the first actuator system and the second actuator system to provide an ambulatory effect.

20 Claims, 4 Drawing Sheets

(56) References Cited

U.S. PATENT DOCUMENTS

| | | | |
|---|---|---|---|
| 2010/0071008 | A1 | 3/2010 | Hu |
| 2011/0018862 | A1 | 1/2011 | Epps |
| 2013/0087392 | A1 | 4/2013 | Lee et al. |
| 2020/0258281 | A1 | 8/2020 | Churchill et al. |
| 2020/0262085 | A1 | 8/2020 | Temple, Jr. |
| 2021/0205999 | A1 | 7/2021 | Mecca et al. |
| 2021/0299881 | A1 | 9/2021 | Krauthamer et al. |
| 2021/0306573 | A1 | 9/2021 | Gutierrez et al. |
| 2022/0143518 | A1 | 5/2022 | Chatrath et al. |

OTHER PUBLICATIONS

PCT/US2023/026006 International Search Report and Written Opinion mailed Oct. 24, 2023.

* cited by examiner

ANIMATED FIGURE WALKING MECHANISM

BACKGROUND

The present disclosure relates generally to an animated figure control system. More specifically, embodiments of the present disclosure relate to an animated figure control system that facilitates animation effects, such as a walking effect.

Amusement parks typically include various attractions that provide unique experiences for guests. For example, an amusement park may include various show performances. As technology has continued to improve, such attractions have increased in sophistication and complexity. There is a corresponding increase in expectations regarding entertainment quality of attractions and a need for more immersive effects.

Generally, animated figures (e.g., puppets, animated characters, marionettes, and/or other animated creatures) may appear to move via actions of a performer, such as a puppeteer, and/or through mechanical actuators. In some cases, movement of the puppeteer may generate corresponding movement of the animated figure, which may generate an illusion or impression that the animated figure is alive, autonomously operating (e.g., operating as an autonomous robot), or the like. Similarly, actuators, motors, and/or other drives may be utilized to cause movement of the animated figure in addition to, or in lieu of, movement of the performer. In some cases, movement of the animated figure may be limited by the ability of the performer. Additionally or alternatively, an audience viewing the animated figure may notice the performer or/and the actuators, motors, and/or drives, thereby reducing a sense of realness and immersion in the entertainment.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an ambulatory animated figure system is provided in accordance with the present disclosure. The system includes an animated figure having a body with a first limb and a second limb extending therefrom. The system also includes a carrier configured to be disposed on a support, and the animated figure extends away from a side of the carrier in a direction. The carrier is coupled to a first limb through a first actuator system, which is configured to move the first limb away from the side of the carrier in the direction and configured to slide an end of the first limb transversely relative to the direction. The carrier is translated relative to the support through a second actuator system. The system also includes a controller communicatively coupled to the first actuator system and the second actuator system and configured to coordinate actuation of the first actuator system and the second actuator system to provide an ambulatory effect.

In an embodiment, a control system is provided in accordance with the present disclosure. The system includes a first actuator system configured to move a first end of a first limb of an animated figure and a second actuator system configured to move a second end of a second limb of the animated figure. The system also includes a third actuator system configured to move a carrier, wherein the animated figure is disposed on the carrier. The system also includes a controller comprising a processor, which is configured to activate the second actuator system to move the second end of the second limb of the animated figure along a direction, activate the third actuator system to move the carrier along the direction in response to the second end of the second limb of the animated figure reaching a position, and operate the second actuator system to move the second end of the second limb of the animated figure opposite the direction in response to the activating of the third actuator system.

In an embodiment, a method is provided in accordance with the present disclosure. The method includes activating a first actuator system to move a first end of a first limb of an animated figure, and the first actuator system is coupled to the first end of the first limb of the animated figure and configured to move the first end. The method also includes activating a second actuator system to move a carrier along the direction in response to the first end of the first limb of the animated figure reaching a position. The animated figure is disposed on the carrier and configured to move with the carrier. The method also includes operating the first actuator system to move the first end of the first limb of the animated figure opposite the direction in response to the activating of the second actuator system.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
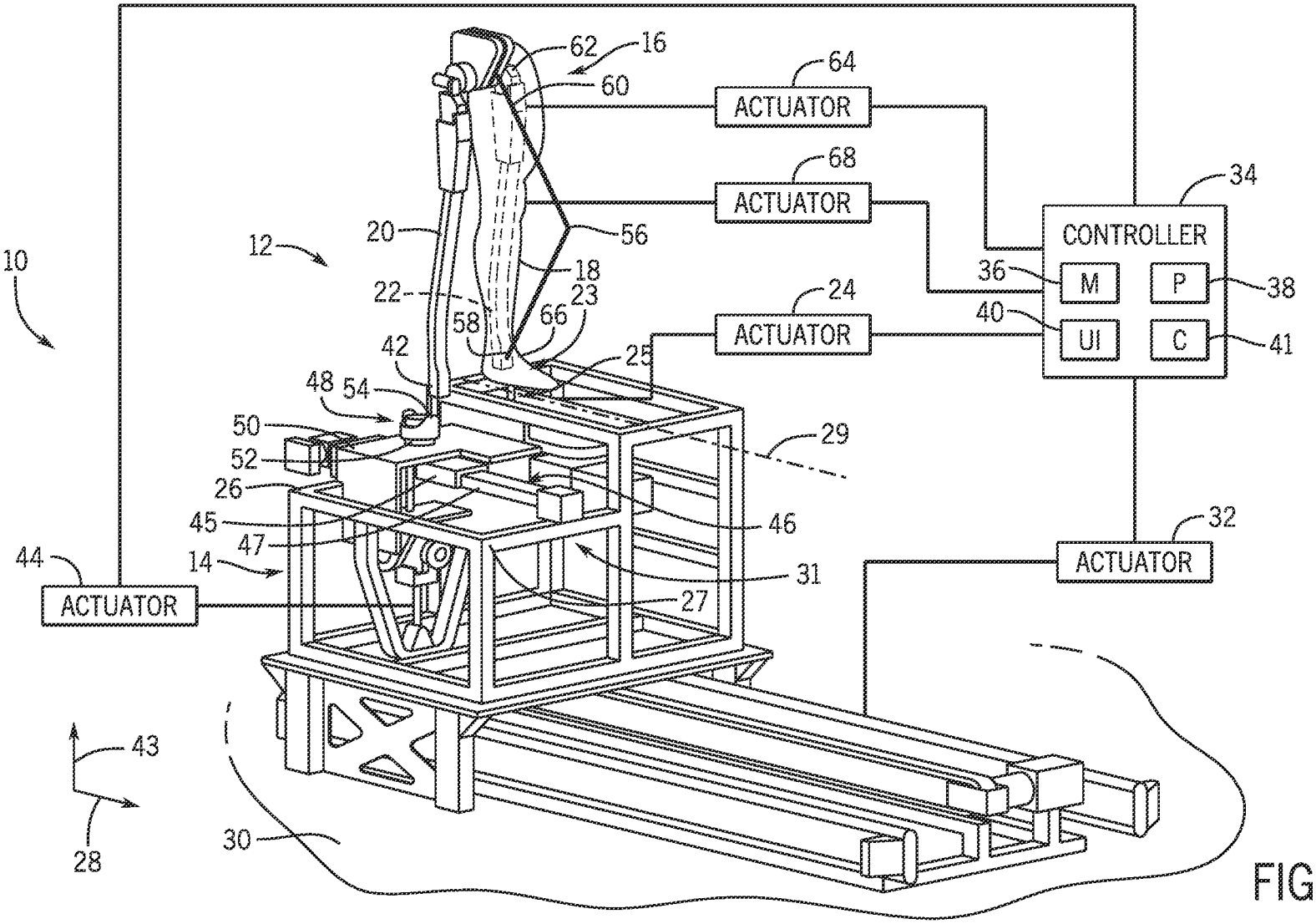
FIG. 1 is a perspective view of an embodiment of an ambulatory animated figure system, in accordance with an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

It has become more common to create performance displays in venues such as amusement parks, wherein the performance displays may include scenery, special effects, audiovisual features, and other media elements that improve a visitor's experience. Specifically, such performance displays (e.g., ride environments) may involve animated figures, which may employ robotics (e.g., soft robotics), puppeteering, mechanical actuation, hydraulic actuation, electrical actuation, and so forth. Creating immersive (e.g., life-like) movements for such animated figures can be difficult, complicated, and expensive. For example, certain movements that occur in nature can be extremely difficult to mimic without employing very complicated stabilization controls along with highly precise mechanics. As a specific example, mimicking realistic ambulatory motions of a human being can be difficult and expensive due to the complexity of balancing the animated figure and concealing actuators, among other issues. Accordingly, it is now recognized that an improved system and method for providing certain movements and movement illusions via an animated figure are desirable to achieve more immersive, efficient, and interesting experiences and narratives in venues such as amusement parks. It should be noted that, as utilized in the present disclosure, the term "animated figure" may include a character, puppet, marionette, animated feature, automated figure, or the like along with supporting components (e.g., a controller, a physical support, a base structure, actuators, motors, aesthetics, theming material).

In accordance with the present disclosure, an animated figure may be utilized to provide an illusion that an otherwise fictional character, creature (e.g., alien robot), device, or the like is alive or active. For example, a controller (e.g., a performer, a control system) may cause movement of an animated figure based on activation (e.g., physical or electrical activation) of actuators. The controller may cause coordinated movement of specific features of the animated figure (e.g., a head, arms, legs, and/or mouth) to mimic or act out certain movement patterns and thus generate an illusion that the animated figure is essentially alive. The animated figure may be controlled via operation of actuators, motors, and/or other drives that cause movement of the animated figure based on instructions from the controller, which may be remote from, integrated with or in close proximity to the animated figure. In addition to creating desired movement patterns or profiles, present embodiments may also incorporate features that provide concealment of operational aspects from audience members. Indeed, certain aspects (e.g., motors, actuators, relational movement) related to control and coordinated movement of the animated figure may be concealed (e.g., camouflaged) so that the audience members do not clearly recognize how the movement of the animated figure is being coordinated and achieved. Further, present embodiments provide such movements or actuations in a manner that facilitates efficient operation, maintenance, and control of the animated figure.

Embodiments of the present disclosure are directed toward an ambulatory animated figure system that uses mechanical mechanisms and actuator placement to allow the figure legs of a character assembly (e.g., a model of a bipedal creatures) to move in a walking pattern. For example, the ambulatory animated figure system may include a cart, dolly, wheel chassis, and/or another suitable transportable frame that may support the character assembly. The character assembly may include structural components or features that resemble the creature or character, actuators (e.g., electronic motors, hydraulic motors) for controlling movement of the components or features, automated control features (e.g., buttons, steering wheels, joysticks, pedals) for activating or deactivating the actuators, manual control features (e.g., stilts, handholds, footholds) for controlling movement of the components or features, auxiliary features, and any combination thereof. As such, the character assembly may be positioned and controlled to create the illusion of a character walking across a platform (e.g., a stage). It should be noted that specific features of the ambulatory animated figure system may be actuated in coordination to provide relative movements (e.g., sliding of a support structure in conjunction with lifting a limb) that create an illusion of movements that are familiar from nature.

Turning to the drawings, FIG. 1 is a perspective view of an embodiment of an ambulatory animated figure system 10, in accordance with embodiments of the present disclosure. As shown in the illustrated embodiment of FIG. 1, the ambulatory animated figure system 10 may include an animated FIG. 12 and a carrier 14 that coordinate to facilitate an animated figure walking effect in accordance with an embodiment of the present disclosure. The animated FIG. 12 may include a body 16, a first limb 18 coupled to the body 16, and a second limb 20 coupled to the body 16. Both the first limb 18 and the second limb 20 may be representative of propulsive limbs (e.g., legs) that are perceived as directly propelling the animated FIG. 12, as opposed to other limps or appendages (e.g., arms) that may be perceived as decorative or supportive (e.g., assisting with balance). It should be noted that, while the illustrated embodiment mimics a bipedal humanoid, other embodiments may employ additional propulsive limbs to mimic other entities (e.g., a quadrupedal figure). It should be noted that reference to "first" and "second" with respect to the limbs 18 and 20 is merely to facilitate discussion and distinction, but these terms could be interchangeable.

As illustrated in FIG. 1, various actuator systems cooperate to move different aspects of the animated figure system 10 to provide an ambulatory effect. That is, the various actuations, when activated or operated in a sequence, make the animated figure system 10 appear to be walking or shuffling along a path. This illusion is generated by tilting the first limb 18 (in various directions relative to other movements), sliding the second limb 20 relative to the carrier 14, and then sliding the carrier 14 relative to the second limb 20, which pulls along the first limb 18 therewith. This series of movements can be repeated and combine to create an impression in viewers that the animated FIG. 12 is walking or shuffling with respect to a supporting structure (e.g., flooring or a stage) relative to which the carrier 14 moves. By using the carrier 14 to provide forward movement and concealing this movement (e.g., in a channel within the supporting structure), the carrier 14 can provide robust support of the animated FIG. 12, which eliminates complex balancing and high power requirements demanded by traditional ambulatory mechanisms. Further, the carrier 14 can house actuation components for the animated FIG. 12, which allows for the use of larger, cheaper and more accessible actuation mechanisms, which improves operational efficiency (e.g., allows for more efficient maintenance and cheaper equipment).

In an embodiment of the present disclosure, a first end 22 of the first limb 18 is coupled to the carrier 14 through a first actuator system 24. The first actuator system 24 may be configured to move the first end 22 in a tilting manner away from and back toward a side 26 of the carrier 14. This forward and backward tilting movement may occur generally along a direction 28 and may impart corresponding motion throughout the first limb 18 and even to other components of the body 16. In particular, the first actuator system 24 may include a pivot joint 23 that actuates to provide such movement or that allows such movement based on actuation of other features of the animated figure system 10 that are coupled thereto. The first actuator system 24 may also be configured to rock the first end 22 of the first limb 18 transversely relative to the direction 28. Specifically, for example, the first actuator system 24 may include a rocker support 25 coupled to the first end 22 (which may also be coupled with or include the pivot joint 23 referenced above), wherein the rocker support 25 rotates about an axis 29 of the first actuator system 24 to cause a rocking movement that is imparted to the first end 22, which may cause corresponding movement of other features of the first limb 18 or even other features of the body 16.

The first actuator system 24 is coupled to the carrier 14 and may include aspects that are housed by or integral with the carrier 14. For example, the carrier 14 may house a motor 31 or other actuation mechanism that causes movement or operation of the first actuator system 24 to achieve the effects discussed above. The carrier 14 may be movably disposed on a support 30 (e.g., a stage, floor, base structure) and coupled to the support 30 through a second actuator system 32 (e.g., a bogie system, a vehicle, a sled, a trolley). The second actuator system 32 may be configured to translate the carrier 14 relative to the support 30. Further, movement of the carrier 14 relative to the support 30 may be camouflaged or hidden to improve the ambulatory illusion. For example, the support 30 itself may conceal the carrier 14 in a groove or behind a panel of the support 30 so that observers cannot see that the carrier is causing the animated FIG. 12 to translate across the support.

In some embodiments, the first actuator system 24 and the second actuator system 32 may be able to provide an ambulatory effect without involving the second limb 20. For example, certain movements of the carrier 14 and the first limb 18 may create some form of ambulatory motion or at least a portion of an ambulatory motion. A controller 34 may be communicatively coupled to the first actuator system 24 and the second actuator system 32. The controller 34 may include a memory device 36 (M), a processor 38 (P), a user interface 40 (UI), and a communication component 41 (C). The controller 34 may be configured to coordinate actuation of the first actuation system 24 and the second actuator system 32 to provide an ambulatory effect or portions of an overall ambulatory effect. For example, the controller 34 may coordinate translation or tilting of the first end 22 of the first limb 18 with respect to the carrier 14 along with the translation of the carrier 14 relative to the support 30, which may provide an illusion that the animated FIG. 12 is hopping or scooting across the support 30. The user interface 40 may be used to receive user input related to an operation of the animated FIG. 12 and the carrier 14. In some embodiments, the animated FIG. 12 and the carrier 14 may be controlled via a preprogrammed sequence stored in the memory device 36 and executed by the processor 38 of the controller 34. In some embodiments, the controller 34 may communicate with other devices through the communication component 41, such as receiving/sending data related to the operation of the animated FIG. 12 and the carrier 14. For example, the animated FIG. 12 may be a part of a story or scene, and it may be controlled to operate in a predetermined pattern with other attractions in the amusement park. The communication component 41 may be a wireless or wired communication component that may facilitate communication between the controller 34 and various other controllers and devices via a network, the internet, or the like. For example, the communication component 41 may allow the controller 34 to obtain the data from a variety of data sources (e.g., databases, network, and the like). In some embodiments, the animated FIG. 12 and the carrier 14 may be remotely controlled through the network. The communication component 41 may use a variety of communication protocols, such as Open Database Connectivity (ODBC), TCP/IP Protocol, Distributed Relational Database Architecture (DRDA) protocol, Database Change Protocol (DCP), HTTP protocol, other suitable current or future protocols, or combinations thereof.

In some embodiments, a second end 42 of the second limb 20 may be coupled to the carrier 14 through a third actuator system 44, which may also (along with the first actuator system 24 and the second actuator system 32) be commutatively coupled to the controller 34. The third actuator system 44 may be configured to move the second limb 20 in multiple ways relative to the carrier 14. For example, the third actuator system 44 may be configured to tilt the second end 42 back and forth generally along the direction 28 (or transversely thereto), lift and lower the second end relative to the carrier 14 along a direction 43 (e.g., perpendicular or otherwise transverse to the direction 28), and slide the second end 42 back and forth generally along the direction 28. Specifically, for example, the third actuator system 44 may include a slide 46 including a sled 45 configured to traverse a guide 47. In the illustrated embodiment, the slide 46 generally extends from a rear (side 26) of the carrier 14 to a front (side 27) of the carrier 14, and, thus, generally along the direction 28 (but also angled relative thereto). Accordingly, when the sled 45 slides back and forth along the guide 47, a sliding motion is imparted to the second limb 20 via the second end 42. Direct sliding movement along direction 28 may create more of a striding illusion, while angled sliding movement relative to the direction 28 may cause more of a limping illusion. In conjunction with this, other aspects of the third actuator system 44 may cause the second end 42 to be elevated and lowered relative to the carrier 14 and/or tilted (e.g., along the direction 43 or transversely thereto) to increase realism of the ambulatory effect. In an embodiment, the slide 46 may be coupled to the second end 42 at a hinge 48. In some embodiments, the slide 46 may be coupled to the second end 42 via an elevator 50, which is coupled to the second end 42 via the hinge 48. The elevator 50 is configured to translate along the guide 47 while changing an elevation of the second end 42. The hinge 48 may include a ball joint 52 extending from a distal portion 54 of the second end 42 of the second limb 20. As noted above, the controller 34 may coordinate operation of the third actuator system 44, the first actuator system 24 and the second actuator system 32. Such coordinated operation based on a series or pattern of actuation instructions may provide an enhanced ambulatory effect, such as an illusion of autonomous movement of the animated FIG. 12, which is illustrated and described in detail in FIG. 2.

In some embodiments, a linkage 56 may be coupled to the first end 22 of the first limb 18 through a first linkage end 58. A second linkage end 60 of the linkage 56 may be coupled to the body 16. In some embodiments, the second linkage end 60 of the linkage 56 may be coupled to a third end 62 of the first limb 18. The linkage 56 is configured to bend away from the first limb 18 when the first actuator system 24 moves the first limb 18 away from the side 26 of the carrier 14 generally in the direction 28. The linkage 56 may be a living hinge, a spring-loaded hinge, a ball bearing hinge, or any combination thereof. In some embodiments, the first linkage end 58 may be coupled to the first end 22 of the first limb 18 via a linkage actuator 64, and the linkage 56 is configured to bend away from the first limb 18 and bend back toward the first limb 18 in an actuation cycle 65 of the linkage actuator 64. In some embodiments, the linkage actuator 64 may be coupled to the first linkage end 58 via a hinge 66. The linkage actuator 64 may be configured to slide the first linkage end 58 back and forth along the first limb 18. A sliding actuator 68 may be coupled to the linkage 56 at a position between the first linkage end 58 and the second linkage end 60, and configured to slide the linkage 56 back and forth generally along the direction 28. The linkage actuator 64 and the sliding actuator 68 may be communicatively coupled to the controller 34. The controller 34 may coordinate operation of the linkage actuator 64 and the sliding actuator 68 to cause the first limb 18 to change poses (e.g., lifting the first limb 18 and at the same time bending around a joint of the first limb 18, and the like) during a walking process of the animated FIG. 12. For instance, during a part of the actuation cycle of the sliding actuator 68, the sliding actuator 68 may slide along the direction 28 and push the linkage 56 away from the first limb 18, which may cause the linkage 56 to lift the first end 22 of the first limb 18 away from the carrier 14. In the illustrated embodiment above, during another part of the actuation cycle of the sliding actuator 68, the sliding actuator 68 may slide along the opposite side of the direction 28 and pull the linkage 56 back to the first limb 18, which may cause the linkage 56 to release the first end 22 of the first limb 18 back to the carrier 14. In some embodiments, a second linkage similar to the first linkage 56 may be coupled to the second limb 20 and may be configured to bend away from the second limb 20 in a similar manner as the one described above for the first linkage 56. In some embodiments, the controller 34 may coordinate operation of the linkage actuator 64 and the sliding actuator 68 with the first actuator system 24, the second actuator system 32, and the third actuator system 44 to provide an enhanced ambulatory effect, such as an illusion of autonomous movement of the animated FIG. 12, which is illustrated and described in detail in FIG. 2. In some embodiments, similar linkage systems are included with the second limb 20 as well.

Figure 2:
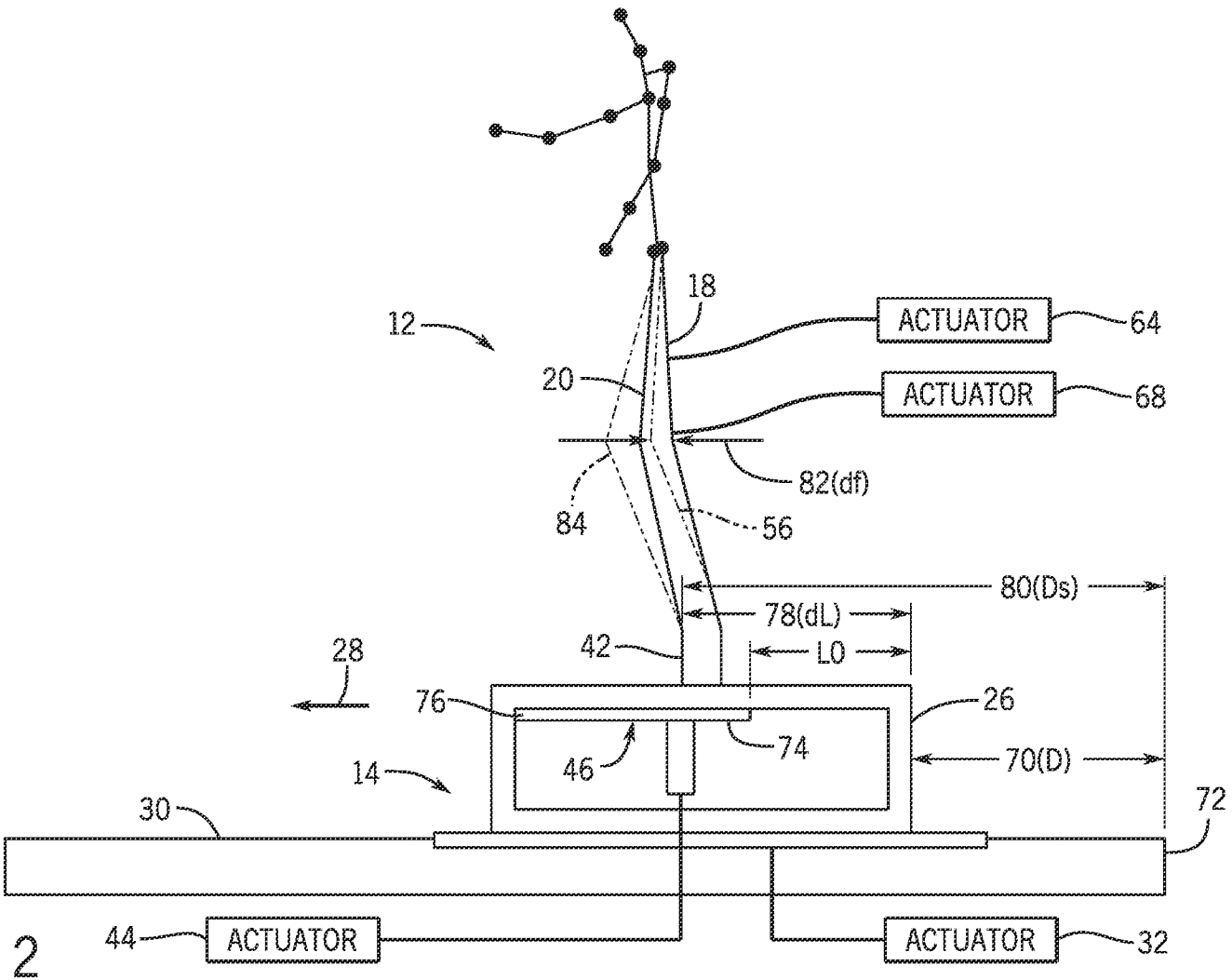
FIG. 2 is a schematic diagram of a side view of an embodiment of the animated figure of FIG. 1, in accordance with an embodiment of the present disclosure.

FIG. 2 illustrates a schematic diagram of a side view of an embodiment of the ambulatory animated figure that may be used in the ambulatory animated figure system of FIG. 1. In some embodiments, the carrier 14 may be located on a support 30, and the side 26 of the carrier 14 may be at a displacement 70 (D) along the direction 28 relative to a reference location 72 on the support 30. The carrier 14 may be configured to be translated along the direction 28 by the actuator system 32.

In FIG. 2, the second end 42 of the second limb 20 may be configured to slide along the slide 46 between a first slide end 74 of the slide 46 and a second slide end 76 of the slide 46. In the embodiment illustrated in the FIG. 2, the second end 42 of the second limb 20 is at a displacement 78 (dL) along the direction 28 relative to the side 26 of the carrier 14. The second end 42 of the second limb 20 is disposed on the carrier 14 at a displacement 80 (Ds) along the direction 28 relative to the reference location 72 on the support 30. Accordingly, the displacement 80 (Ds) is a sum of the displacement 78 (dL) and the displacement 70 (D). In the embodiment illustrated in the FIG. 2, the first slide end 74 of the slide 46 is at a displacement L0 (e.g., a predetermined value) along the direction 28 relative to the side 26. The movement of the second end 42 along the direction 28 may be controlled by the actuator system 44.

In the illustrated embodiment, the displacement 80 (Ds) of the second end 42 of the second limb 20 along the direction 28 relative to the reference location 72 on the support 30 is a sum of the displacement 78 (dL) and the displacement 70 (D). The actuator system 32 and the actuator system 44 may be configured to cooperate to provide the illusion of autonomous movement of the animated FIG. 12. For example, in the illustrate embodiment, at a time t0, the second end 42 may be located at the first slide end 74 of the slide 46. Accordingly, in the embodiment, the displacement 78 (dL) has a value of L0 at the time t0. The displacement 70 (D) of the side 26 relative to the reference location 72 on the support 30 may have a value D0. Accordingly, the displacement 80 (Ds) may have a value equal to the sum of L0 and D0. At a time t1, the actuator system 44 may start to move the second end 42 along the direction 28 in response to receiving a trigger signal and change the displacement 78 (dL) accordingly. At a time t2, the second end 42 may stop at a location on the slide 46 with the displacement 78 (dL) having a value of D1, and D1 may be greater than L0 in the illustrated embodiment. However, in other embodiments, the actuator system 44 may move the second end 42 along an opposite direction of the direction 28, and D1 may be less than L0 at the time t2. The actuator system 32 may not be activated (or otherwise maintain the location of the second end 42) during the time period from the time t0 to the time t2. The animated FIG. 12 may start an idling period at the time t2, during which the animated FIG. 12 may conduct actions without changing the displacement 78 (dL) of the second end 42 and the displacement 70 (D) of the side 26 of the carrier 14, the actions may include talking, making gestures, making expressions, changing poses, and the like. It should be noted that, the animated FIG. 12 may move the first limb, the second limb, and/or other parts of the body 16 during the idling period, such as lifting, rotating, shaking, changing poses, and the like. At a time t3, the actuator system 32 may start to move the carrier 14 along the direction 28 and the actuator system 44 may simultaneously conduct an operation to move the second end 42 along an opposite direction of the direction 28. The actuator system 32 and the actuator system 44 may cooperate in a way so that the displacement 70 (D) caused by the actuator system 32 to the carrier 14 has the same value as the displacement 78(dL) caused by the actuator system 44 to the second end 42 but with an opposite direction. Thus, the actuator system 32 and the actuator system 44 may cooperate to provide an illusion that the second end 42 of the second limb 20 is standing still relative to the support 30, and the first limb 18 is moving relative to the second limb 20. At a time t4, the side 26 of the carrier 14 may be at a displacement of D1 with respective to the reference location 72 on the support 30, while the second end 42 may return to the first slide end 74 of the slide 46. Therefore, when the carrier 14 is concealed from a viewer, the viewer may have an illusion that the animated FIG. 12 is walking across the support 30 without any external controlling (e.g., actuators, boom arms, threads, and the like).

In the embodiment illustrated in the FIG. 2, the linkage 56 of the first limb 18 may be configured to bend away from the first limb 18 and bend back toward the first limb 18 throughout the actuation cycle 65 of the linkage actuator 64. In the embodiment described above, the sliding actuator 68 may keep the linkage 56 at a displacement 82 (*df*) from the first limb 18. During the time period from the time t0 to the time t3, the displacement 82 (*df*) may have a same value df0, i.e., the sliding actuator 68 may keep the linkage 56 still with respect to the first limb 18. At the time t3, the sliding actuator 68 may push the linkage 56 away from the first limb 18 and thus increase the value of the displacement 82 (*df*). At a time ts, the displacement 82 (*df*) may have a value of df1, and the sliding actuator 68 may start to pull the linkage 56 back to the first limb 18 and thus decrease the value of the displacement 82 (*df*). At the time t4, the linkage 56 may return to its position at the time t0, i.e., the displacement 82 (*df*) has a value of df0. The sliding actuator 68 may cooperate with other actuators (e.g., the linkage actuator 64, the first actuator system 24) to provide an illusion of the first limb 18 bending during moving. In FIG. 2, a second linkage 84 for the second limb 20 is illustrated. It should be noted that, a slide (e.g., similar to the slide 46) may also be installed for the first limb 18 so that the first limb 18 may be configured to move relative to the carrier 14.

Figure 3:
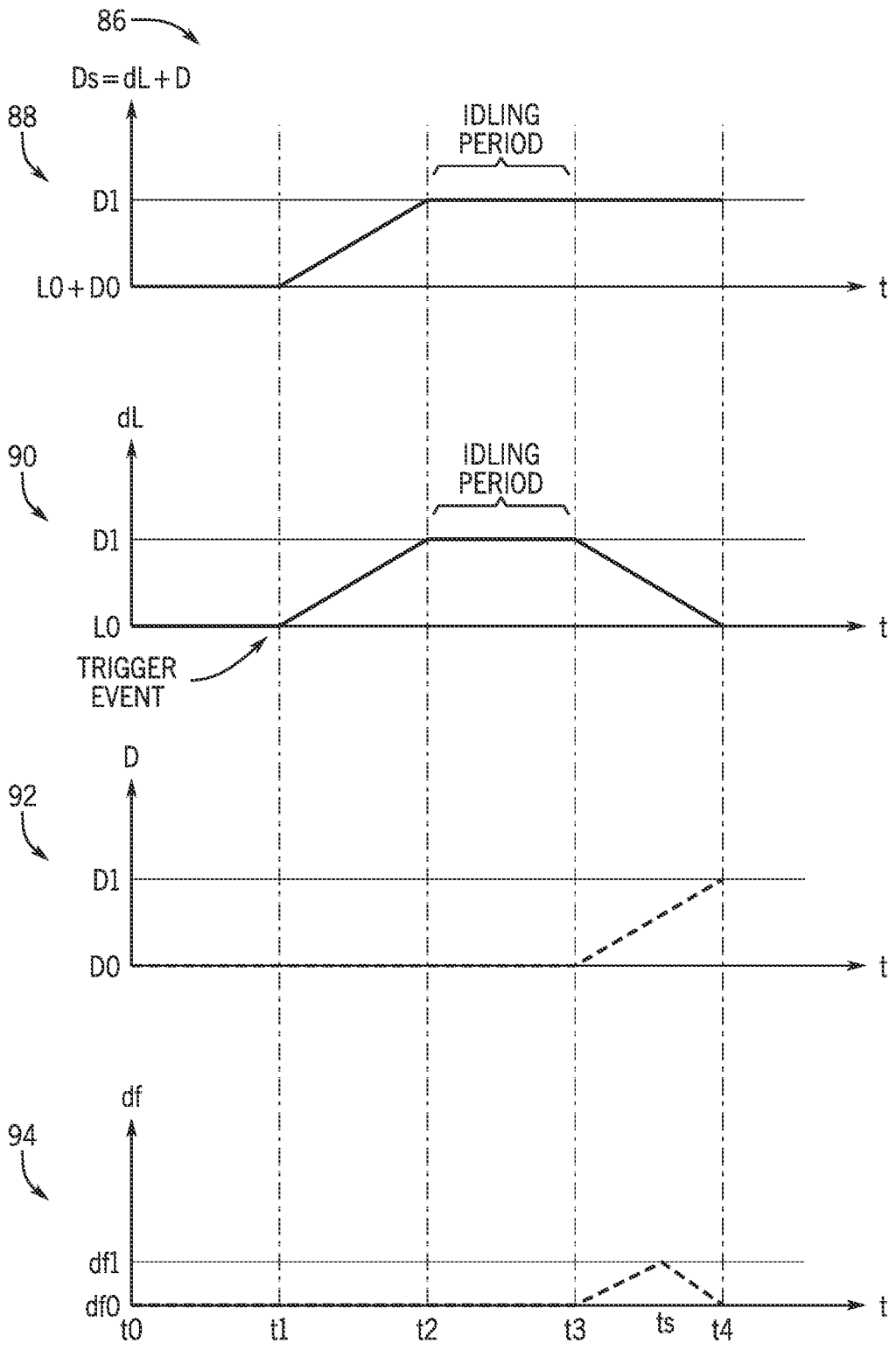
FIG. 3 is a comparison of translation timings of actuator systems that may be used in the ambulatory animated figure system of FIG. 1, in accordance with an embodiment of the present disclosure.

FIG. 3 illustrates a time diagram comparison 86 of translation timings of the animated figure system 10 in certain embodiments as described in the FIG. 2 above. Plot 88 illustrates an embodiment for the displacement 80 (Ds) with respect to the translation time t (i.e., t0, t1, t2, t3, and t4). Plot 90 illustrates the displacement 78 (dL) with respect to the translation time t (i.e., t0, t1, t2, t3, and t4) in the embodiment. Plot 92 illustrates the displacement 70 (D) with respect to the translation time t (i.e., t0, t1, t2, t3, and t4) in the embodiment. Plot 94 illustrates the displacement 82 (*df*) with respect to the translation time t (i.e., t0, t1, t2, t3, and t4) in the embodiment. It should be noted that, in other embodiments, the displacement 80 (Ds) with respect to the translation time t, the displacement 78 (dL) with respect to the translation time t, the displacement 70 (D) with respect to the translation time t, or the displacement 82 (*df*) with respect to the translation time t may not be straight lines (i.e., the displacement changing speed may be varied over time for 80 (Ds), 78 (dL), 70 (D), or 82 (*df*)). For example, in some embodiments, during the time period between time t1 and time t2, the second end 42 of the second limb 20 may move faster at time t1 and slower at time t2, may pause movement, may move back and forth along the direction 28, and so forth. Accordingly, the displacement 78(dL) may not be a straight line during the time period between time t1 and time t2.

In the described embodiment in FIG. 3, at time t0, the displacement 80 (Ds) may be the sum of the displacement 70 (D) (i.e., D0) of the side 26 and the displacement 78 (dL) (i.e., L0, that is the second end 42 is located at the first slide end 74 of the slide 46) of the second end 42, as illustrated in the plots 88, 90, and 92.

At time t1, the actuator system 44 may start to move the second end 42 along the direction 28 and increase the displacement 78 (dL) in response to a trigger event, as illustrated in the plot 90.

At time t2, the second end 42 of the second limb 20 may be translated to a position on the slide 46 with the displacement 78 (dL) having a value D1, and the actuator system 44 may stop moving the second end 42 along the direction 28. The idling period may start at time t2, as illustrated in the plot 90.

At time t3, the actuator system 32 may be activated and move the carrier along the direction 28, as illustrated in the plot 92. At time t3, the actuator system 44 may move the second end 42 along the opposite of the direction 28 and the displacement 78 (dL) may be decreased, as illustrated in the plot 90. However, the displacement 80 (Ds) may stay unchanged due to the cooperation between the actuator system 32 and the actuator system 44, as illustrated in the plot 88. At time t3, the sliding actuator may be activated and move the linkage 56 away from the first limb 18, which may increase the displacement 82 (*df*), as illustrated in the plot 94. At time is (e.g., ts<t4), the displacement 82 (*df*) may have a value of df1, and the sliding actuator may start to move the linkage 56 back to the first limb 18, which may decrease the displacement 82 (*df*).

At time t4, the side 26 of the carrier 14 may be translated (along with the carrier 14) to a location with the displacement 70 (D) having a value of D1, and the second end 42 of the second limb may be moved back to the first slide end 74 of the slide (i.e., the displacement 78 (dL) having a value of L0), as illustrated in the plots 90 and 92. At time t4, the linkage 56 may be pulled back to the first limb 18 so that the displacement 82 (*df*) may have the value of df0, as illustrated in the plot 94. However, at time t4, the displacement 80 (Ds) may stay unchanged and have the value of D1 due to the relationship between the displacement 80 (Ds), displacement 70 (D), and the displacement 78 (dL), as illustrated in the plot 88.

Figure 4:
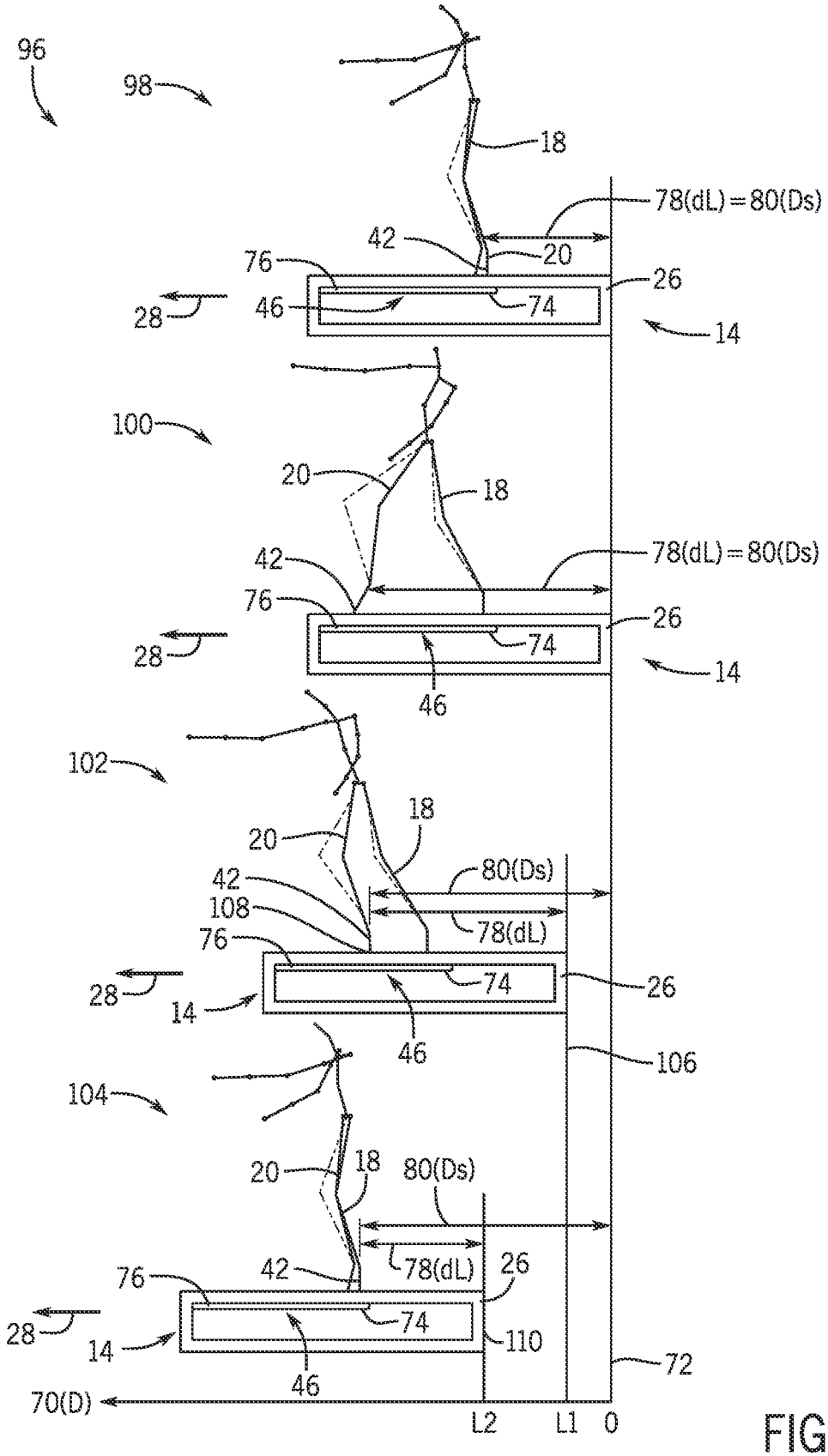
FIG. 4 includes a series of schematic diagrams of a side view of an embodiment of the animated figure of FIG. 1 to illustrate an ambulatory effect, in accordance with an embodiment of the present disclosure.

FIG. 4 illustrates create series of positioning diagrams that show relative positioning of aspects of the animated figure system 10 over a time period of operation, in accordance with present embodiments. Together, diagrams 98, 100, 102, and 104 depict an ambulatory effect 96 of the animated figure system 10 with corresponding relationships of the displacements 70 (D), 80 (Ds) and 78 (dL) to create the illusion of the animated FIG. 12 walking on the support 30.

Diagrams 98 and 100 illustrate a first relationship between the displacement 78 (dL) and 80 (Ds) when the carrier 14 is not moving relative to the reference location 72 on the support 30 along the direction 28, i.e., 78 (dL)=80 (Ds) and 70 (D)=0. In diagram 98, the second end 42 of the second limb 20 is at the first slide end 74 of the slide 46, and the side 26 of the carrier 14 is at the reference location 72, i.e., 70 (D)=0. In diagram 100, the second end 42 of the second limb 20 moves to the second slide end 76 of the slide 46 with the side 26 of the carrier 14 positioned at the reference location 72, i.e., 70 (D)=0. That is, diagrams 98 and 100 together illustrate the animated FIG. 12 walking with the second limb 20 stepping forward along the direction 28 on the carrier 14.

Diagram 102 illustrates the side 26 of the carrier 14 moved forward along the direction 28 to a location 106, which has a displacement of L1 relative to the reference location 72 along the direction 28. Accordingly, the displacement 70 (D) has a value of L1 in diagram 102, i.e., 78 (dL)+L1=80 (Ds). At the same time, the second end 42 of the second limb 20 moves along the opposite of the direction 28 to a location 108 on the slide 46, and the location 108 is located between the first slide end 74 and the second slide end 76 of the slide 46. That is, in context of other positions, the positioning depicted by diagram 102 creates an illusion that the first limb 18 of the animated FIG. 12, which is moving along the direction 28 with the carrier 14, moves on the support and follows the second limb 20.

Diagram 104 illustrates the side 26 of the carrier 14 moved further along the direction 28 to a location 110, which has a displacement of L2 relative to the reference location 72 along the direction. Accordingly, the displacement 70 (D) has a value of L2 in diagram 104, i.e., 78 (dL)+L2=80 (Ds). At the same time, the second end 42 of the second limb 20 moves along the opposite of the direction 28 and back to the first slide end 74 of the slide 46. That is, diagram 104 creates an illusion that the first limb 18 of the animated FIG. 12, which is moving along the direction 28 with the carrier 14, moves on the support 30 and catches the second limb 20.

Accordingly, FIG. 4 illustrates the ambulatory effect 96 of the animated FIG. 12 walking a step forward along the direction 28 on the support 30 by using relative positions of the carrier 14, the first limb 18 (which is not moving relative to the carrier 14 in the illustrated embodiment), the second limb 20, and the reference location 72 on the support 30. It should be noted that various actuator systems may cooperate together to move different aspects of the animated figure system 10 to provide the ambulatory effect 96 illustrated in FIG. 4. Further, it should be noted that FIG. 4 is intended to show an aspect of the ambulatory effect 96 provided by embodiments of the present disclosure, but other movements or ambulatory effects may also be achieved by present embodiments that vary in positioning, magnitude, path, and so forth.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An ambulatory animated figure system, comprising:

an animated figure having a body with a first limb and a second limb extending therefrom;

a carrier configured to be disposed on a support, wherein the animated figure extends away from a side of the carrier in a first direction;

a first actuator system coupled to the carrier and to the first limb, wherein the first actuator system is configured to slide an end of the first limb along a second direction;

a second actuator system configured to translate the carrier relative to the support; and a controller communicatively coupled to the first actuator system and the second actuator system and configured to coordinate actuation of the first actuator system and the second actuator system to provide an ambulatory effect, wherein the controller is configured to:

operate the first actuator system to slide the end of the first limb along the second direction;

operate the second actuator system to move the carrier along the second direction based on positioning of the end of the first limb; and operate the first actuator system to slide the end of the first limb opposite the second direction based on positioning of the carrier.

2. The ambulatory animated figure system of claim 1, wherein the first actuator system is configured to move the first limb away from the side of the carrier in the second direction.

3. The ambulatory animated figure system of claim 1, comprising a third actuator system coupled to the carrier and coupled to the second limb, wherein the third actuator system is configured to move the second limb away from the side of the carrier in the first direction, tilt the second limb relative to the carrier, or both.

4. The ambulatory animated figure system of claim 3, wherein the third actuator system is configured to translate an end portion of the second limb.

5. The ambulatory animated figure system of claim 1, comprising a third actuator system coupled to the second limb, wherein the third actuator system comprises a slide coupled to an end of the second limb and wherein the slide is configured to translate.

6. The ambulatory animated figure system of claim 1, wherein the first actuator system comprises a slide including a sled configured to traverse a guide, wherein the first limb is coupled to the sled at a hinge.

7. The ambulatory animated figure system of claim 1, wherein the first limb is coupled to a sled via an elevator and a hinge, and the elevator is configured to translate along the first direction.

8. The ambulatory animated figure system of claim 7, wherein the hinge comprises a ball joint extending from a distal portion of the first limb.

9. The ambulatory animated figure system of claim 1, comprising a linkage having a first linkage end coupled to the end of the first limb and a second linkage end coupled to the body or an additional end of the first limb, wherein the linkage is configured to bend away from the first limb.

10. The ambulatory animated figure system of claim 9, wherein the linkage is configured to bend away from the first limb in response to the first actuator system moving the first limb away from the side of the carrier in the first direction.

11. The ambulatory animated figure system of claim 9, wherein the linkage comprises a living hinge, a spring-loaded hinge, or a ball bearing hinge.

12. The ambulatory animated figure system of claim 9, wherein the first linkage end is coupled to the end of the first limb via a linkage actuator and the linkage is configured to bend away from the first limb and bend back toward the first limb throughout an actuation cycle of the linkage actuator.

13. The ambulatory animated figure system of claim 1, wherein the first limb and the second limb are ambulatory limbs.

14. The ambulatory animated figure system of claim 1, comprising a first linkage coupled to the first limb and a second linkage coupled to the second limb, wherein the first linkage is configured to bend away from the first limb upon actuation of the first linkage and the second linkage is configured to bend away from the second limb upon actuation of the second linkage.

15. A control system, comprising:

a first actuator system configured to move a first end of a first limb of an animated figure;

a second actuator system configured to move a second end of a second limb of the animated figure;

a third actuator system configured to move a carrier, wherein the animated figure is disposed on the carrier; and a controller comprising a processor, wherein the processor is configured to:

activate the second actuator system to move the second end of the second limb of the animated figure along a direction;

activate the third actuator system to move the carrier along the direction in response to the second end of the second limb of the animated figure reaching a position; and operate the second actuator system to move the second end of the second limb of the animated figure opposite the direction in response to the activating of the third actuator system.

16. The control system of claim 15, wherein the controller is configured to activate the first actuator system in response to activation of the third actuator system.

17. The control system of claim 16, wherein the first actuator system comprises a linkage actuator system configured to move a linkage of the first limb of the animated figure along the first limb.

18. The control system of claim 17, wherein the linkage actuator system comprises a slide linkage actuator configured to move the linkage transversely relative to the first limb.

19. The control system of claim 15, wherein the second actuator system is configured to move the second end of the second limb along a slide, wherein the slide is coupled to the second limb.

20. A method comprising:

activating a first actuator system to move a first end of a first limb of an animated figure along a direction, wherein the first actuator system is coupled to the first end of the first limb of the animated figure and configured to move the first end;

activating a second actuator system to move a carrier along the direction based on positioning of the first end of the first limb, wherein the animated figure is disposed on the carrier and configured to move with the carrier; and operating the first actuator system to move the first end of the first limb of the animated figure opposite the direction based on positioning of the carrier.

* * * * *